US008039419B2

(12) United States Patent
Ohga

(10) Patent No.: US 8,039,419 B2
(45) Date of Patent: Oct. 18, 2011

(54) HEAT SENSITIVE RECORDING MATERIAL

(75) Inventor: Kunihiko Ohga, Fujinomiya (JP)

(73) Assignee: FUJIFILM Corporation, Tokyo (JP)

( * ) Notice: Subject to any disclaimer, the term of this patent is extended or adjusted under 35 U.S.C. 154(b) by 1078 days.

(21) Appl. No.: 11/849,484

(22) Filed: Sep. 4, 2007

(65) Prior Publication Data

US 2008/0058207 A1 Mar. 6, 2008

(30) Foreign Application Priority Data

Sep. 1, 2006 (JP) ..... 2006-237809

(51) Int. Cl.
*B41M 5/333* (2006.01)

(52) U.S. Cl. ..... 503/216; 503/207

(58) Field of Classification Search ..... None
See application file for complete search history.

(56) References Cited

U.S. PATENT DOCUMENTS

| | | | | |
|---|---|---|---|---|
| 4,722,921 | A * | 2/1988 | Kiritani et al. | 503/207 |
| 6,852,671 | B2 * | 2/2005 | Iwasaki et al. | 503/216 |

FOREIGN PATENT DOCUMENTS

| | | | |
|---|---|---|---|
| JP | 5-573 | A | 1/1993 |
| JP | 6-30953 | B2 | 4/1994 |
| JP | 8-90914 | A | 4/1996 |
| JP | 2004-216878 | A | 8/2004 |

* cited by examiner

*Primary Examiner* — Bruce H Hess

(74) *Attorney, Agent, or Firm* — Sughrue Mion, PLLC

(57) ABSTRACT

The invention provides a heat sensitive recording material comprising heat sensitive recording layer provided on a support and having a hollow particle and a heat sensitive coloring component.

10 Claims, No Drawings

HEAT SENSITIVE RECORDING MATERIAL

CROSS-REFERENCE TO RELATED APPLICATION

This application claims priority under 35 USC 119 from Japanese Patent Application No. 2006-237809, the disclosure of which is incorporated by reference herein.

BACKGROUND OF THE INVENTION

1. Field of the Invention

The invention relates to a heat sensitive recording material and in particular to a heat sensitive recording material excellent in color gradation reproduction.

2. Description of the Related Art

A heat sensitive recording method is advantageous in that (1) development is unnecessary, (2) when the support is a paper, its paper quality is similar to that of common paper, (3) handling is easy, (4) color optical density is high, (5) a recording apparatus is simple and inexpensive, and (6) there is no noise at the time of recording. Accordingly, use of heat sensitive recording is wide-spreading in fields such as facsimile and printer and label such as POS.

Under these circumstances, transparent heat sensitive recording materials capable of direct recording with a thermal head for coping with multiple colors or for projection of an image with an overhead projector (OHP), or for observing an image directly on a light table, have also been developed in recent years. There is increasing demand for image qualities with these heat sensitive recording materials.

As the sensitivity of the heat sensitive recording material is increased to cope with high-speed recording, an initial rise in color development tends to be steep in response to printing energy. As a result, image color gradation has been sacrificed.

To satisfy both sensitivity and image color gradation, a heat sensitive recording material having, on a support, a second coloring layer and a first coloring layer laminated thereon having the same coloring tone, wherein the first coloring layer forms color at lower temperatures than the second coloring layer, has been developed (see, for example, Japanese Patent Application Publication (JP-B) No. 6-30953). In this heat sensitive recording material, the coloring of the first coloring layer is prioritized in printing at low temperatures, while the coloring of the second coloring layer is utilized in printing at high temperatures.

A heat sensitive recording material excellent in color gradation reproduction, provided with a heat sensitive recording layer containing an electron-donating dye precursor-encapsulated microcapsule and an electron-accepting compound, has been proposed (see, for example, Japanese Patent Application Laid-Open (JP-A) No. 2004-216878).

It has also been proposed that a hollow particle-containing undercoat layer is arranged on a support to attain higher sensitivity of a heat sensitive recording material (see, for example, JP-A No. 5-573).

SUMMARY OF THE INVENTION

The heat sensitive recording materials described in JP-B No. 6-30953 or JP-A No. 2004-216878 have a problem of failure to achieve sufficient sensitivity and image density. The heat sensitive recording material described in JP-A No. 5-573 fails to achieve sufficient color gradation reproduction.

The present invention provides a heat sensitive recording material excellent in image color gradation reproduction with which it is possible to obtain high sensitivity and image density.

A first aspect of the invention provides a heat sensitive recording material comprising a heat sensitive recording layer provided on a support and having a hollow particle and a heat sensitive coloring component.

DETAILED DESCRIPTION OF THE INVENTION

The heat sensitive recording material of the present invention is a material in which a heat sensitive recording layer containing at least one kind of hollow particle and at least one kind of heat sensitive coloring component is arranged on a support. By including hollow particles having heat insulating properties into the heat sensitive recording layer, heating insulating properties are imparted to the heat sensitive recording layer itself, and the heat conductance of the heat sensitive recording layer is decreased. The surface part (at the opposite side to the support) of the heat sensitive recording layer can thereby effectively utilize heat energy owing to a heat accumulation effect and can thus form color with less heat energy applied (that is, color is formed with higher sensitivity). The heat energy necessary for forming color from the surface part to the lower-layer part of the heat sensitive recording layer is increased, and therefore, the ratio of change of color optical density to heat energy applied is decreased, and thus the heat sensitive recording layer is endowed with softening color gradation. That is, a highly sensitive heat sensitive recording material having excellent color gradation reproduction can be obtained.

[Heat Sensitive Recording Layer]

The heat sensitive recording layer in the invention contains at least one kind of hollow particle and at least one kind of heat sensitive coloring component. If necessary, the heat sensitive recording layer in the invention can further contain an adhesive, an image stabilizer (ultraviolet absorber etc.) and other components.

(Hollow Particles)

The hollow particles in the invention may be fine particles having air or another gas therein and are preferably spherical or elliptical fine particles. A shell of the hollow particle may be composed of an organic material or an inorganic material. The organic material means a synthetic polymer compound which may be a thermoplastic polymer compound or a thermosetting polymer compound. The inorganic material means metals, metal oxides, ceramics and so on.

From the viewpoint of ease of manufacturing and particle size control, the shell of the hollow particle in the invention is composed preferably of an organic material. Specific examples of the organic material can include polystyrene, polyvinyl chloride, polyvinylidene chloride, polyvinyl acetate, polyacrylate, polyacrylonitrile, polybutadiene and copolymers thereof, as well as phenol resin, epoxy resin, melamine resin, urea resin and unsaturated polyester resin.

The shell of the hollow particle in the invention is composed more preferably of a thermosetting polymer compound. Higher sensitivity and image density can thereby be attained.

The average particle diameter of the hollow particle in the invention is preferably 5.0 μm or less. If an average particle diameter is 5.0 μm or less, the smoothness of the coating surface after drying can be favorably high, and printing disturbance can hardly occur. The average particle diameter is preferably 0.2 μm or more. When the average particle diameter is 0.2 μm or more, sufficient heat insulating properties can be conferred to improve sensitivity and color gradation reproduction. When the average particle diameter is 0.2 μm or more, the degree of hollowness can be preferably easily regulated.

As used herein, the average particle diameter can be determined as arithmetic mean value of particle diameter of 100 hollow particles measured by using an electron microscope.

The degree of hollowness of the hollow particle in the invention is preferably 40 to 90%, more preferably 60 to 90%. When the degree of hollowness is in these ranges, sufficient heat insulating properties can be attained.

The degree of hollowness means the ratio of the inner diameter to the outer diameter of a hollow particle and is represented by the following equation (1). The outer diameter and inner diameter are determined by observing a section of a hollow particle.

$$\text{Degree of hollowness}=((\text{inner diameter of hollow particle})/(\text{outer diameter of hollow particle}))\times 100(\%) \quad \text{equation (1)}$$

From the viewpoint of color gradation reproduction and printing quality, the average particle diameter of the hollow particle in the invention is preferably 5 μm or less, while the degree of hollowness of the hollow particle is preferably 40 to 90%. It is more preferable that the average particle diameter of the hollow particle is 0.5 to 2.0 μm, while the degree of hollowness thereof is 60 to 90%.

The hollow particles can be prepared by methods described in Japanese Patent No. 2614707. Alternatively, the hollow particles can be obtained from Rohm and Haas, JSR Co., Ltd., etc. The hollow particles may be used by itself or in a combination of two or more thereof.

The content of the hollow particles in the heat sensitive recording layer in the invention is preferably in the range of 5 to 50 weight %, more preferably in the range of 10 to 25 weight %, based on the total solid content of the heat sensitive recording layer. When the content of the hollow particles is in these ranges, excellent sensitivity and color gradation reproduction can be achieved.

(Heat Sensitive Coloring Component)

The heat sensitive coloring component in the invention refers to a compound or composition which changes spectral absorption at least in the visible region upon application of heat energy. As the heat sensitive coloring components, those known in the art can be used without particular limitation, and specific examples include a combination of a diazonium salt compound and a coupler, a combination of an electron-donating dye precursor and an electron-accepting compound, etc.

As the diazonium salt compound and the coupler, those known in the art can be used without particular limitation. Specifically, at least one kind of diazonium salt compound and at least one kind of coupler described in JP-A No. 2003-246147, etc. can be used. The diazonium salt compound is preferably encapsulated into a microcapsule prior to use.

As the electron-donating dye precursor and the electron-accepting compound, a known combination of an electron-donating dye precursor and an electron-accepting compound reacting with the electron-donating dye precursor thereby developing color can be used without particular limitation.

From the viewpoint of sensitivity and color forming property, the heat sensitive coloring component in the invention is preferably a composition containing at least one kind of electron-donating dye precursor and at least one electron-accepting compound which reacts with the electron-donating dye precursor thereby developing color.

Electron-Donating Dye Precursor

The heat sensitive coloring component in the invention preferably contains at least one kind of electron-donating dye precursor. The electron-donating dye precursor can be suitably selected from those known in the art. Examples of the electron-donating dye precursor preferably include phthalide compounds such as triphenyl methane phthalide and indolyl phthalide, fluoran compounds, phenothiazine compounds, leucoauramine compounds, rhodamine lactam compounds, triarylmethane compounds, triazene compounds, spirodipyran compounds, pyridine compounds, pyrazine compounds and fluorene compounds. The fluorine- or phthalide-based electron-donating dye precursors are particularly preferable.

Examples of the phthalide compounds include those described in, for example, U.S. Pat. No. 23,024 (reissued), U.S. Pat. No. 3,491,111, U.S. Pat. No. 3,491,112, U.S. Pat. No. 3,491,116 and U.S. Pat. No. 3,509,174.

Examples of the fluoran compounds include those described in, for example, U.S. Pat. No. 3,624,107, U.S. Pat. No. 3,627,787, U.S. Pat. No. 3,641,011, U.S. Pat. No. 3,462,828, U.S. Pat. No. 3,681,390, U.S. Pat. No. 3,920,510 and U.S. Pat. No. 3,959,571.

Examples of the spirodipyran compounds include those described in, for example, U.S. Pat. No. 3,971,808.

Examples of the pyridine compounds and pyrazine compounds include those described in, for example, U.S. Pat. No. 3,775,424, U.S. Pat. No. 3,853,869 and U.S. Pat. No. 4,246,318.

Examples of the fluorene compounds include those described in, for example, in JP-A No. 63-94878.

Specific examples of the electron-donating dye precursor include 2-anilino-3-methyl-6-diethylaminofluoran, 2-anilino-3-methyl-6-dibutylaminofluoran, 2-anilino-3-methyl-6-(N-ethyl-N-isoamylamino)fluoran, 2-anilino-3-methyl-6-(N-ethyl-N-propylamino)fluoran, 2-anilino-3-methyl-6-di-n-amylaminofluoran, 2-anilino-3-methyl-6-(N-ethyl-N-p-tolylamino) fluoran, 2-anilino-3-methyl-6-N-ethyl-N-sec-butylaminofluoran, 3-(N-n-hexyl-N-ethylamino)-6-methyl-7-anilino fluoran, 3-[N-(3-ethoxypropyl)-N-ethylamino]-6-methyl-7-anilino fluoran, 3-di(n-butylamino)-7-(2-chloroanilino) fluoran, 3-diethylamino-7-(2-chloroanilino)fluoran, 3-(N-cyclohexyl-N-methylamino)-6-methyl-7-anilinofluoran, 2-anilino-3-methyl-6-(N-isobutyl-N-methylamino)fluoran, 2-anilino-3-methyl-6-(N-n-amyl-N-methylamino)fluoran, 2-anilino-3-methyl-6-(N-n-amyl-N-ethylamino)fluoran, 2-anilino-3-methyl-6-(N-n-propyl-N-isopropylamino)fluoran, 2-anilino-3-methyl-6-(N-methyl-N-p-toluidino) fluoran, 3-diethylamino-7,8-benzofluoran, 1,3-dimethyl-6-diethylaminofluoran, 1,3-dimethyl-6-di-n-butylaminofluoran, 3-diethylamino-7-methylfluoran, 3-diethylamino-7-chlorofluoran, 3-diethylamino-6-methyl-7-chloro fluoran, 10-diethylamino-2-ethylbenzo[1,4]thiadino[3,2-b]fluoran, 3,3-bis(1-n-butyl-2-methylindol-3-yl)phthalide, 3,3-bis(4-diethylamino-2-ethoxyphenyl)-4-azaphthalide, 3-[2,2-bis(1-ethyl-2-methyl-3-indolyl)vinyl]-3-(4-diethylaminophenyl) phthalide, and 3-[1,1-bis(4-diethylaminophenyl)ethylen-2-yl)-6-dimethylaminophthalide.

Among these compounds, it is particularly preferable to include at least one member selected from the group consisting of 2-anilino-3-methyl-6-diethylaminofluoran, 2-anilino-3-methyl-6-dibutylaminofluoran, 2-anilino-3-methyl-6-(N-ethyl-N-isoamylamino)fluoran, 2-anilino-3-methyl-6-(N-ethyl-N-propylamino)fluoran, 2-anilino-3-methyl-6-di-N-amylaminofluoran, and 2-anilino-3-methyl-6-(N-ethyl-N-p-tolylamino)fluoran. These electron-donating dye precursors may be used by itself or in a combination of two or more thereof in a single heat sensitive recording layer.

When at least one kind compound selected from the above group is contained as the electron-donating dye precursor is included, background fog can be kept low and color optical density can be increased. And further the image storage stability of an image part formed can be improved.

When a coating solution for forming the heat sensitive recording layer (hereinafter referred to sometimes as "coating solution for heat sensitive recording layer") is prepared, the particle size of the electron-donating dye precursor is preferably 2.0 μm or less, more preferably 0.5 to 1.2 μm, in terms of volume-average particle diameter. A volume-average particle diameter of 2.0 μm or less is preferable because of high heat sensitivity. A volume-average particle diameter of 0.5 μm or more is preferable for less background fog. The volume-average particle diameter can be easily measured by a laser diffraction particle size distribution measuring instrument (for example, LA500 manufactured by Horiba, Ltd.) etc.

From the viewpoint of the unused stock storability (fog prevention) of the heat sensitive recording layer, such as prevention of contacting with the electron-accepting compound at ordinary temperature and from the viewpoint of control of color forming sensitivity, such as color forming with desired heat energy, the electron-donating dye precursor in the invention can be used encapsulated into microcapsules before use.

The microcapsules usable in the invention can be produced by any methods of interfacial polymerization, internal polymerization and external polymerization. It is particularly preferable to use an interfacial polymerization method wherein a core substance containing the electron-donating dye precursor is emulsified in an aqueous solution having a water-soluble polymer dissolved therein, and then a wall of the polymer material is formed around its oil droplets. A reactant forming the polymer material is added to the inside of oil droplets and/or the outside of oil droplets.

Specific examples of the polymer material include polyurethane, polyurea, polyamide, polyester, polycarbonate, urea-formaldehyde resin, melamine resin, polystyrene, a styrene/methacrylate copolymer and a styrene/acrylate copolymer. The polymer material is preferably polyurethane, polyurea, polyamide, polyester or polycarbonate, more preferably polyurethane or polyurea. That is, the microcapsule preferably has a polymer film wall having urethane or urea bonds. The polymer materials can also be used by a combination of two or more thereof.

Specific examples of the water-soluble polymer include gelatin, polyvinyl pyrrolidone, polyvinyl alcohol etc. A method for manufacturing a microcapsule composite wall is described in detail in, for example, JP-A No. 58-66948. When the electron-donating dye precursor is encapsulated into microcapsules, the electron-donating dye precursor is dissolved in an organic solvent prior to use.

Such organic solvent includes low-boiling solvents such as ethyl acetate, methyl acetate, carbon tetrachloride, chloroform, methanol, ethanol, n-butanol, dioxane, acetone and benzene, and high-boiling solvents such as carboxylates such as phosphate and phthalate, fatty acid amides, alkylated biphenyl, alkylated terphenyl, chlorinated paraffin, alkyl naphthalene and diaryl ethane. Such organic solvents are described in detail in JP-A No. 4-19778. Microcapsules substantially not containing an organic solvent as shown in JP-A No. 4-101885 can also be used.

If necessary, a metal-containing dye, a charge regulator such as nigrosine, and other additives can be added to the microcapsule wall used in the invention. These additives can be added at an arbitrary time point before or during formation of the wall. For regulating charging of the surface of the microcapsule wall, vinyl monomers or the like may be added and graft-polymerized.

A solid sensitizer for swelling the microcapsule wall during heating may further be added to the microcapsules encapsulating the electron-donating dye precursor. A solid sensitizer having a melting point of 50° C. or more (preferably 120° C. or less) and being solid at normal temperature, selected from plasticizers for polymers used as microcapsule walls, may be used. For example, when the wall material is composed of polyurea or polyurethane, a hydroxy compound, a carbamate compound, an aromatic alkoxy compound, an organic sulfonamide compound, an aliphatic amide compound, an aryl amide compound or the like can be preferably used.

The amount of the electron-donating dye precursor applied is preferably 0.1 to 3.0 g/m$^2$, more preferably 0.2 to 1.5 g/m$^2$, from the viewpoint of color optical density and background fog.

Electron-Accepting Compound

The heat sensitive coloring component in the invention preferably contains at least one kind of an electron-accepting compound which reacts with the electron-donating dye precursor thereby allowing the precursor to be colored. The electron-accepting compound can be suitably selected from those known in the art.

The electron-accepting compound in the invention is preferably at least one kind of compound represented by formula (I) below. By including the compound as an electron-accepting compound, the heat sensitive recording layer can attain higher sensitivity with excellent color gradation reproduction by keeping background fog low and suppressing printing blurring and can also simultaneously improve the storage characteristics of a formed image for a long time (image storage characteristics), chemical resistance, ink jet suitability, and head matching property with a thermal head.

formula (I)

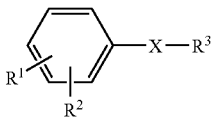

wherein $R^1$ and $R^2$ independently represent a hydrogen atom, an alkyl group, an alkenyl group, a hydroxyl group, a halogen atom or —$SO_2$Ar, and $R^3$ represents —Ar, —NH—Ar or —NH—CO—NH—Ar, whereupon Ar represents an aromatic ring. The aromatic ring may be substituted with at least one member selected from substituent groups including a hydroxyl group, an alkyl group, an alkenyl group, an alkoxy group, a halogen atom and —$SO_2$Ar.

X represents a divalent linking group represented by any of the followings:

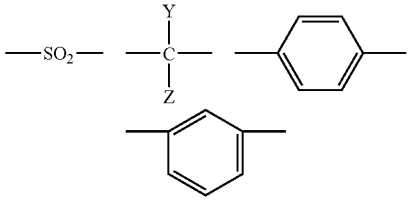

wherein Y and Z independently represent a hydrogen atom or an alkyl group, and Y and Z may be bound to each other to form a ring. The alkyl group represented by Y or Z is preferably an alkyl group having 1 to 12 carbon atoms, more preferably an alkyl group having 1 to 8 carbon atoms. Specific examples of the alkyl group can include a methyl group, an ethyl group, a propyl group, a butyl group and a hexyl group.

At least one of $R^1$ and $R^2$ is preferably a hydroxyl group.

The alkyl group represented by $R^1$ or $R^2$ is preferably an alkyl group having 1 to 4 carbon atoms, more preferably a methyl group, an ethyl group, an isopropyl group or a t-butyl group. The alkenyl group represented by $R^1$ or $R^2$ is preferably a vinyl group or an allyl group. The halogen atom represented by $R^1$ or $R^2$ is preferably a fluorine atom, a chlorine atom or a bromine atom.

The above-mentioned Ar is preferably a benzene ring or naphthalene ring which may have a substituent group. The substituent group is preferably a hydroxyl group, an alkyl group (for example, a methyl group, an ethyl group, an isopropyl group etc.), an alkenyl group (for example, a vinyl group, an allyl group etc.), an alkoxy group (for example, a methoxy group, an ethoxy group, an isopropyloxy group etc.), a halogen atom (for example, a fluorine atom, a chlorine atom, a bromine atom etc.), or a substituent group containing —$SO_2$Ar. The "substituent group containing —$SO_2$Ar" includes —$CH_2$—$C_6H_4$—NHCONH—$SO_2$—$C_6H_5$, —$CH_2$—$C_6H_4$—NHCONH—$SO_2$—$C_6H_4$—$CH_3$, —$SO_2$—$C_6H_5$, —$SO_2$—$C_6H_4$—$CH_3$, —$SO_2$—$C_6H_4$—Cl, and so on.

In the invention, preferable specific examples of the compounds represented by the formula (I) above include 2,4-bis(phenylsulfonyl)phenol, 4-hydroxybenzene sulfonanilide (=p-N-phenylsulfamoylphenol), p-N-(2-chlorophenyl)sulfamoylphenol, p-N-3-tolylsulfamoylphenol, p-N-2-tolylsulfamoylphenol, p-N-(3-methoxyphenyl)sulfamoylphenol, p-N-(3-hydroxyphenyl)sulfamoylphenol, p-N-(4-hydroxyphenyl)sulfamoylpheno 1,2-chloro-4-N-phenylsulfamoylphenol, 2-chloro-4-N-(3-hydroxyphenyl) sulfamoylphenol, 4'-hydroxy-p-toluene sulfonanilide, 4,4'-bis(p-toluenesulfonylaminocarbonylamino) diphenylmethane (=BTUM), 4-hydroxy-4'-isopropoxydiphenylsulfone, 2,2'-bis(4-hydroxyphenol)propane (bisphenol A), 4-t-butylphenol, 4-phenylphenol, 4-hydroxydiphenoxide, 1,1'-bis(4-hydroxyphenyl)cyclohexane, 1,1'-bis(3-chloro-4-hydroxyphenyl)cyclohexane, 1,1'-bis(3-chloro-4-hydroxyphenyl)-2-ethylbutane, 4,4'-sec-isooctylidene diphenol, 4,4'-sec-butyrylenediphenol, 4-tert-octylphenol, 4-p-methylphenylphenol, 4,4'-methylcylohexylidene phenol, 4,4'-isopentylidene phenol, and benzyl p-hydroxybenzoate.

however, the invention is not limited to these specific examples.

Among the electron-accepting compounds represented by the formula (I) above, 2,4-bis(phenylsulfonyl)phenol, 4-hydroxybenzene sulfonanilide and 4-hydroxy-4'-isopropoxydiphenylsulfone are preferable in respect of the balance between image storage characteristics and background fog.

The electron-accepting compound is also preferably any compound selected from salicylic acid derivatives and polyvalent metal salts thereof.

The salicylic acid derivatives include, for example, 4-pentadecyl salicylic acid, 3,5-di(α-methylbenzyl) salicylic acid, 3,5-di(tert-octyl) salicylic acid, 5-octadecyl salicylic acid, 5-α-(p-α-methylbenzylphenyl)ethyl salicylic acid, 3-α-methylbenzyl-5-tert-octyl salicylic acid, 5-tetradecyl salicylic acid, 4-hexyloxy salicylic acid, 4-cyclohexyloxy salicylic acid, 4-decyloxy salicylic acid, 4-dodecyloxy salicylic acid, 4-pentadecyloxy salicylic acid, 4-octadecyloxy salicylic acid, 4-(n-pentanoylamino) salicylic acid, 4-(n-hexanoylamino) salicylic acid, 4-(n-octanoylamino) salicylic acid, 4-(hexadecanoylamino)salicylic acid, 4-(N'-n-butylcarbamoylamino) salicylic acid, 4-(N'-n-hexylcarbamoylamino)salicylic acid, 4-(N'-n-octylcarbamoylamino)salicylic acid, 4-(N'-hexadecylcarbamoylamino)salicylic acid, 4-(n-octyloxycarbonylamino)salicylic acid, 4-(n-nonyloxycarbonylamino)salicylic acid, 4-(n-decyloxycarbonylamino)salicylic acid, 4-(n-undecyloxycarbonylamino)salicylic acid, 4-(n-dodecyloxycarbonylamino)salicylic acid, 4-(n-tridecyloxycarbonylamino)salicylic acid, 4-(n-tetradecyloxycarbonylamino)salicylic acid, 4-(n-pentadecyloxycarbonylamino)salicylic acid, 4-(n-hexadecyloxycarbonylamino)salicylic acid, 4-(n-octadecyloxycarbonylamino) salicylic acid, 3-(n-octyloxycarbonylamino)salicylic acid, 3-(n-nonyloxycarbonylamino)salicylic acid, 3-(n-decyloxycarbonylamino)salicylic acid, 3-(n-undecyloxycarbonylamino)salicylic acid, 3-(n-dodecyloxycarbonylamino)salicylic acid, 3-(n-tridecyloxycarbonylamino)salicylic acid, 3-(n-tetradecyloxycarbonylamino)salicylic acid, 3-(n-pentadecyloxyloxycarbonylamino)salicylic acid, 3-(n-hexadecyloxycarbonylamino)salicylic acid, 3-(n-octadecyloxycarbonylamino)salicylic acid, 5-(n-octyloxycarbonylamino) salicylic acid, 5-(n-nonyloxycarbonylamino)salicylic acid, 5-(n-decyloxycarbonylamino)salicylic acid, 5-(n-undecyloxycarbonylamino)salicylic acid, 5-(n-dodecyloxycarbonylamino)salicylic acid, 5-(n-tridecyloxycarbonylamino)salicylic acid, 5-(n-tetradecyloxycarbonylamino)salicylic acid, 5-(n-pentadecyloxycarbonylamino)salicylic acid, 5-(n-hexadecyloxycarbonylamino)salicylic acid, and 5-(n-octadecyloxycarbonylamino)salicylic acid.

Polyvalent metal salts of the salicylic acid derivatives include zinc, aluminum, calcium, copper or lead salts of the salicylic acid derivatives.

The content of the electron-accepting compound in the heat sensitive recording layer is preferably 50 to 400 weight %, more preferably 100 to 300 weight %, based on the weight of the electron-donating dye precursor.

In the invention, an electron-accepting compound represented by the formula (I) above and an electron-accepting compound selected from the salicylic acid derivatives and polyvalent metal salts thereof are preferably simultaneously used.

When the known electron-accepting compounds are simultaneously used, the content of the electron-accepting compound represented by the formula (I) above is preferably 50 weight % or more, more preferably 70 weight % or more, based on the total weight of the electron-accepting compounds.

In preparation of a coating solution for forming the heat sensitive recording layer, the particle diameter of the electron-accepting compound is preferably 2.0 μm or less, more preferably 0.5 to 1.2 μm, in terms of volume-average particle diameter. The volume-average particle diameter of 2.0 μm or less is preferable for higher heat sensitivity. The volume-average particle diameter of 0.5 μm or more is preferable because of background fog hardly occurs. The volume-average particle diameter can be measured by a laser diffraction particle size distribution measuring instrument (LA500 manufactured by Horiba, Ltd.).

The electron-accepting compound is dissolved in a water-sparingly-soluble or water-insoluble organic solvent, then mixed with an aqueous phase having a surfactant and a water-soluble polymer as protective colloid, and emulsified to give an emulsified dispersion. In the invention, the resulting emulsified dispersion may be used.

Sensitizer

The heat sensitive coloring component in the invention contains not only the electron-donating dye precursor and the electron-accepting compound but also a sensitizer. By containing the sensitizer, sensitivity can be significantly improved. As the sensitizer in the invention, a known sensitizer can be suitably selected and used. Examples of such sensitizers include 2-benzyloxynaphthalene, dimethylbenzyl oxalate, m-terphenyl, ethylene glycol tolyl ether, p-benzyl biphenyl, 1,2-diphenoxy methyl benzene, 1,2-diphenoxyethane, diphenylsulfone, aliphatic monoamide, aliphatic bisamide, stearyl urea, di(2-methylphenoxy)ethane, di(2-methoxyphenoxy)ethane, β-naphthol-(p-methylbenzyl) ether, α-naphthyl benzyl ether, 1,4-butanediol-p-methyl phenyl ether, 1,4-butanediol-p-isopropyl phenyl ether, 1,4-butanediol-p-tert-octyl phenyl ether, 1-phenoxy-2-(4-ethylphenoxy)ethane, 1-phenoxy-2-(chlorophenoxy)ethane, 1,4-butanediol phenyl ether, diethylene glycol bis(4-methoxyphenyl)ether and 1,4-bis(phenoxymethyl)benzene. These sensitizers can be used by itself or in a combination of two or more thereof.

Among the sensitizers described above, at least one member selected from the group consisting of 2-benzyloxynaphthalene, dimethylbenzyl oxalate, m-terphenyl, ethylene glycol tolyl ether, p-benzyl biphenyl, 1,2-diphenoxymethyl benzene, 1,2-diphenoxyethane and diphenyl sulfone is particularly preferably contained in the invention.

The content of the total content of the sensitizers in the heat sensitive recording layer is preferably 75 to 200 parts by weight, more preferably 100 to 150 parts by weight, based on 100 parts by weight of the electron-accepting compound. When the content is in the above range, an effect of improving sensitivity is significant, and image storage characteristics can also be improved.

Inorganic Pigment

The heat sensitive coloring component in the invention can further contain an inorganic pigment in addition to the electron-donating dye precursor and the electron-accepting compound in such a range that the effect of the invention is not deteriorated. By containing the inorganic pigment, head matching property with a thermal head to be contacted can be further improved.

The inorganic pigment can be suitably selected from those known in the art. Particularly, at least one member selected from calcite-based calcium carbonate, amorphous silica and aluminum hydroxide is preferably contained.

From the viewpoint of improving color optical density and of preventing a deposit from adhering to a thermal head, the content of the inorganic pigment in the heat sensitive recording layer is preferably 50 to 500 parts by weight, more preferably 70 to 350 parts by weight, still more preferably 90 to 250 parts by weight, based on 100 parts by weight of the electron-accepting compound.

Adhesive

The heat sensitive recording layer in the invention preferably contains an adhesive (or a protective colloid at the time of dispersion) in addition to the heat sensitive coloring component. Examples of the adhesive can include polyvinyl alcohol, modified polyvinyl alcohol, a vinyl acetate-acrylamide copolymer, starch, modified starch, methyl cellulose, carboxymethyl cellulose, hydroxymethyl cellulose, gelatin, gum arabic, casein, styrene-maleic acid copolymer hydrolysates, polyacrylamide derivatives, polyvinyl pyrrolidone, and latex such as styrene-butadiene rubber latex, acrylonitrile-butadiene rubber latex, methyl acrylate-butadiene rubber latex, and vinyl acetate emulsion.

In the invention, the adhesive is particularly preferably polyvinyl alcohol, and modified polyvinyl alcohols such as sulfo modified polyvinyl alcohol, diacetone modified polyvinyl alcohol and acetoacetyl modified polyvinyl alcohol can also be used. By containing the modified polyvinyl alcohol as adhesive in the heat sensitive recording layer, standard paper-like feel can be obtained and simultaneously the adhesion between the heat sensitive recording layer and a support can be increased, and troubles such as paper peel in offset printing can be prevented, and printing suitability can be improved. Further, color optical density upon recording with a thermal head can further be improved while background fog is kept low.

The above-mentioned polyvinyl alcohols may be used by itself or in a combination of two or more thereof or in combination with other modified polyvinyl alcohols or polyvinyl alcohols. When the other modified polyvinyl alcohols or polyvinyl alcohols are used, the content of the above-mentioned modified polyvinyl alcohol is preferably 10 weight % or more, more preferably 20 weight % or more, based on the total weight of the adhesive components.

The degree of saponification of the above-mentioned polyvinyl alcohol is preferably 85 to 99 mol %. When the degree of saponification is 85 mol % or more, water resistance to dampening water used in offset printing can be maintained. As a result, paper peel can be prevented. When the degree of saponification is 99 mol % or less, undissolved materials can be prevented from occurring in preparation of the coating solution, and generation of insufficient coating can be prevented. When the other modified polyvinyl alcohols and polyvinyl alcohols are simultaneously used, the other modified polyvinyl alcohols and polyvinyl alcohols preferably have degrees of saponification in the above range in order to prevent deterioration in the effect of the invention.

The degree of polymerization of the above-mentioned polyvinyl alcohol is preferably 200 to 2000. When the degree of polymerization is 200 or more, paper peel upon offset printing can be prevented. When the degree of polymerization is 2000 or less, the polyvinyl alcohol is easily dissolved in a solvent (water), and an increase in liquid viscosity at the time of preparation can be prevented, and thus preparation and application of a coating solution for forming the heat sensitive recording layer can be well conducted. When the other modified polyvinyl alcohols and polyvinyl alcohols are simultaneously used, the other modified polyvinyl alcohols and polyvinyl alcohols preferably have degrees of saponification in the above range in order to prevent deterioration in the effect of the invention.

The degree of polymerization refers to an average degree of polymerization as determined by a method described in JIS-K6726 (1994).

From the viewpoint of improving color optical density and of conferring offset printing suitability (prevention of paper peel etc.), the content of the polyvinyl alcohols in the heat-sensitive recording layer is preferably 30 to 300 parts by weight, more preferably 70 to 200 parts by weight, still more preferably 100 to 170 parts by weight, based on 100 parts of the electron-donating dye precursor. The polyvinyl alcohol not only functions as an adhesive for improving interlayer adhesion but also functions as a dispersant, a binder and so on.

Image Stabilizer

Preferably the heat sensitive recording layer in the invention further contains an image stabilizer (containing an ultraviolet absorber) in addition to the heat sensitive coloring component. The ultraviolet absorber may be encapsulated into microcapsules. By containing the image stabilizer, the storage stability of a colored image formed (image storage characteristics) can further be improved.

For example, a phenol compound, particularly a hindered phenol compound, is effective as the image stabilizer. Examples of the image stabilizer include 1,1,3-tris(2-methyl-4-hydroxy-5-tert-butylphenyl)butane, 1,1,3-tris(2-methyl-4-hydroxy-5-cyclohexylphenyl)butane, 1,1,3-tris(2-ethyl-4-hydroxy-5-cyclohexylphenyl)butane, 1,1,3-tris(3,5-di-tert-butyl-4-hydroxyphenyl)butane, 1,1,3-tris(2-methyl-4-hydroxy-5-tert-butylphenyl)propane, 2,2'-methylene-bis(6-tert-butyl-4-methylphenol), 2,2'-methylene-bis(6-tert-butyl-4-ethylphenol), 4,4'-butylidene-bis(6-tert-butyl-3-methylphenol), 4,4'-thio-bis-bis(3-methyl-6-tert-butylphenol) etc. The image stabilizers may be used by itself or in a combination of two or more thereof.

Among these compounds, 1,1,3-tris(2-methyl-4-hydroxy-5-tert-butylphenyl)butane and 1,1,3-tris(2-methyl-4-hydroxy-5-cyclohexylphenyl)butane are particularly preferable.

From the viewpoint of preventing background fog and of effectively improving image storage characteristics, the total content of the image stabilizers in the heat sensitive recording layer is preferably 10 to 100 parts by weight, more preferably 20 to 60 parts by weight, based on 100 parts by weight of the electron-donating dye precursor. When 1,1,3-tris(2-methyl-4-hydroxy-5-tert-butylphenyl)butane and/or 1,1,3-tris(2-methyl-4-hydroxy-5-cyclohexylphenyl)butane are used in combination with the other image stabilizers described above, the content of 1,1,3-tris(2-methyl-4-hydroxy-5-tert-butylphenyl)butane and/or 1,1,3-tris(2-methyl-4-hydroxy-5-cyclohexylphenyl)butane in the single heat sensitive recording layer is preferably 50 weight % or more, more preferably 70 weight % or more, based on the total weight of the image stabilizers.

The ultraviolet absorber can include ultraviolet compounds shown below.

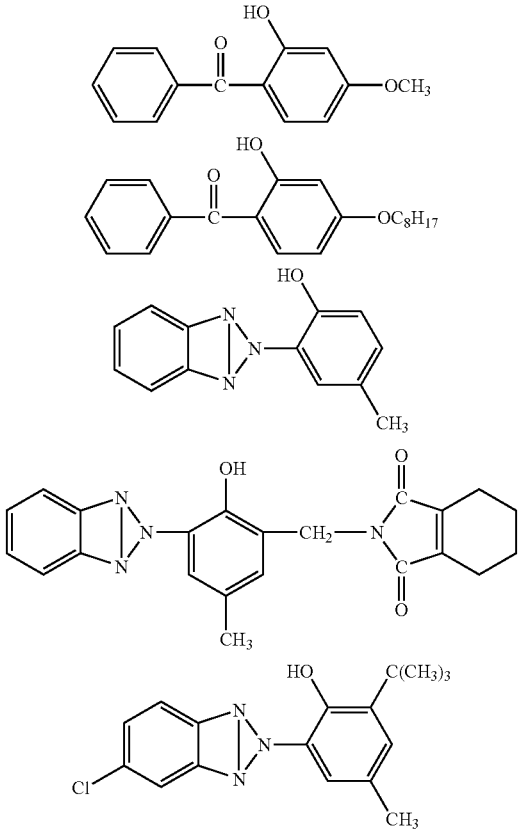

-continued

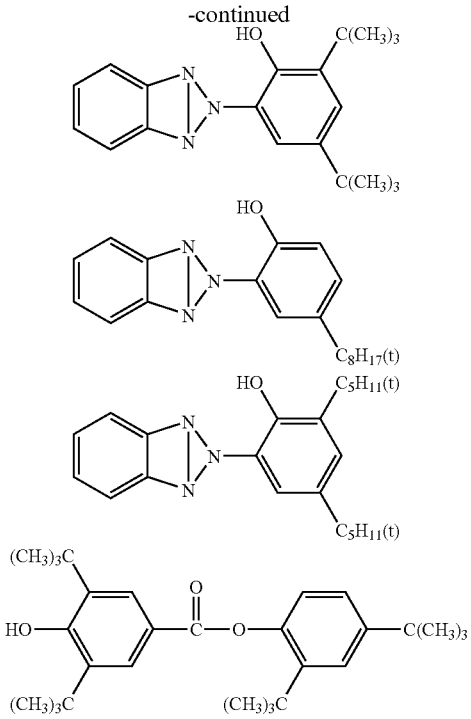

From the viewpoint of effectively improving image storage characteristics, the content the ultraviolet absorber in the single heat sensitive recording layer is preferably 10 to 300 parts by weight, more preferably 30 to 200 parts by weight, based on 100 parts by weight of the electron-donating dye precursor.

Other Components

Depending on the object and necessity, the heat sensitive recording layer in the invention may also contain other components such as a cross-linking agent, a mordant, a metal soap, a wax, a surfactant, an antistatic agent, a defoaming agent and a fluorescent dye, in addition to the components described above.

Cross-Linking Agent

The heat sensitive recording layer may also contain a cross-linking agent acting on the modified polyvinyl alcohol or the like used as the adhesive (or protective colloid). By containing the cross-linking agent, the water resistance of the heat sensitive recording material can be improved. The cross-linking agent can be suitably selected from those capable of cross-linking the modified polyvinyl alcohol. An aldehyde compound such as glyoxal or a dihydrazide compound such as adipic acid dihydrazide is particularly preferable as the cross-linking agent. The content of the cross-linking agent in the heat sensitive recording layer is preferably 1 to 50 parts by weight, more preferably 3 to 20 parts by weight, based on 100 parts by weight of the modified polyvinyl alcohol or the like as the object of cross-linkage. When the content of the cross-linking agent is in the range described above, water resistance can be effectively improved.

Mordant

For the purpose of preventing bleeding at the time of ink jet recording, the heat sensitive recording layer may also contain a mordant. The mordant includes compounds containing at least one kind of cation group selected from an amido group, an imido group, a primary amino group, a secondary amino group, a tertiary amino group, a primary ammonium salt group, a secondary ammonium salt group, a tertiary ammonium salt group and a quaternary ammonium salt group.

Specific examples of the mordant include a polyamide epichlorohydrin, a polyvinyl benzyl trimethyl ammonium chloride, a polydiallyl dimethyl ammonium chloride, a polymethacryloyloxyethyl-β-hydroxyethyl dimethyl ammonium chloride, a polydimethyl aminoethyl methacrylate hydrochloride, a polyethylene imine, a polyallyl amine, a polyallylamine hydrochloride, a polyamide-polyamine resin, a catonized starch, a dicyandiamide/formalin condensate, a dimethyl-2-hydroxypropyl ammonium salt polymer substance, and so on.

In addition to the compounds described above, cationized polymers are also preferable. The cationized polymers include, for example, polyethylene imine, polydiallyl amine, polyallyl amine, polydiallyl dimethyl ammonium chloride, polymethacryloyloxyethyl-β-hydroxyethyl dimethyl ammonium chloride, polyallylamine hydrochloride, polyamide-polyamine resin, cationized starch, a dicyandiamide/formalin condensate, a dimethyl-2-hydroxypropyl ammonium salt polymer substance, polyamidine, polyvinyl amine, and so on.

The molecular weight of the mordant is preferably about 1000 to 200000. When the molecular weight is less than 1000, water resistance tends to be insufficient, while when the molecular weight is greater than 200000, viscosity may be increased to deteriorate handling suitability. The cationized polymer may be added to either the heat sensitive recording layer or a protective layer described later.

Metal Soap, Wax, Surfactant

The metal soap includes higher fatty acid metal salts. Specific examples include a zinc stearate, a calcium stearate, an aluminum stearate and so on.

The wax includes, for example, a paraffin wax, a microcrystalline wax, a carnauba wax, a methylol stearoamide, a polyethylene wax, a polystyrene wax, and a fatty acid amide-based wax. These waxes may be used by itself or in a combination of two or more thereof.

The surfactant includes, for example, a sulfosuccinic acid-based alkali metal salts, a fluorine-containing surfactants, and so on.

[Preparation of the Heat Sensitive Recording Material]

When the heat sensitive recording layer in the heat sensitive recording material of the invention contains a hollow particle, an electron-donating dye precursor and an electron-accepting compound as heat sensitive coloring components, an inorganic pigment, an adhesive and a sensitizer, for example, the heat sensitive coloring components are subjected simultaneously or separately to dispersion with a stirrer/pulverizer such as a ball mill, an atrighter, a sand mill and can be prepared as a coating solution. If necessary, the above-mentioned other components, that is, a cross-linking agent, a mordant, a metal soap, a wax, a surfactant, a binder, an anti-static agent, a defoaming agent and a fluorescent dye are added to the coating solution.

After a coating solution is prepared, the coating solution is applied onto the surface of a support to form a heat sensitive recording layer thereon. A method of applying the coating solution is not particularly limited, and may be selected suitably from coating methods of using an air knife coater, a roll coater, a blade coater, a curtain coater and so on. After coating, the coating solution is dried. After drying, the heat sensitive recording layer is subjected to smoothing treatment preferably by calendering prior to use. When the heat sensitive recording layer is formed by coating, the amount of the coating solution applied is preferably less than 10 g/m$^2$, more preferably 7 g/m$^2$ or less.

In the invention, a curtain coating method of using a curtain coater is preferable in that high density (high sensitivity) can be achieved with a small amount of the materials used, and simultaneously image quality can also be improved. When a protective layer or the like is also laminated in addition to the heat sensitive recording layer as described later, a plurality of such layers are simultaneously applied in the form of a multilayer by the curtain coating method, whereby the consumption energy at the time of production can further be reduced. This can be carried out specifically in the following manner.

The heat sensitive recording material is produced preferably by curtain coating a single coating solution or a plurality of coating solutions onto the surface of a support and then drying a single layer or a part or all of layers thus arranged on the support. The type of layer formed by curtain coating is not limited. The type of layer includes a primer layer, heat sensitive recording layer and protective layer. It is also a preferable mode that a series of these adjacent layers are simultaneously applied in the form of a multilayer by curtain coating.

Specific combinations of layers in the case of multilayer simultaneous application are not limited. The Specific combinations include a combination of the primer layer and heat sensitive recording layer, a combination of the heat sensitive recording layer and protective layer, a combination of the primer layer, heat sensitive recording layer and protective layer, a combination of 2 or more different kinds of primer layers, a combination of 2 or more different kinds of heat sensitive recording layers, and a combination of 2 or more different kinds of protective layers.

A curtain coater used in curtain coating is not limited. The curtain coater includes an extrusion hopper type curtain coater and a slide hopper type curtain coater. Among these curtain coaters, a slide hopper type curtain coater, described in JP-B No. 49-24133, that is used in producing a photograph photosensitive material is particularly preferable. Multilayer simultaneous application can be easily carried out by using this slide hopper type curtain coater.

[Protective Layer]

In the invention, at least one protective layer is preferably arranged on the heat-sensitive recording layer, from the viewpoint of image storage characteristics and head matching property with a thermal head. The protective layer can be constructed by containing organic or inorganic fine powders, a binder, a surfactant, a thermoplastic substance and so on.

The fine powder includes, for example, inorganic fine powders such as a calcium carbonate, a silica, a zinc oxide, a titanium oxide, an aluminum hydroxide, a zinc hydroxide, a barium sulfate, a kaolin, a clay, a talc, and surface-treated calcium, silica or the like, and organic fine powders such as an urea-formalin resin, a styrene/methacrylic acid copolymer, a polystyrene or the like.

The binder contained in the protective layer can include, for example, polyvinyl alcohol, carboxy-modified polyvinyl alcohol, a vinyl acetate/acrylamide copolymer, silicon-modified polyvinyl alcohol, starch, modified starch, methyl cellulose, carboxymethyl cellulose, hydroxymethyl cellulose, gelatin, gum arabic, casein, styrene-maleic acid copolymer hydrolysates, polyacrylamide derivatives, polyvinyl pyrrolidone, and latex such as styrene-butadiene rubber latex, acrylonitrile-butadiene rubber latex, methyl acrylate-butadiene rubber latex, and vinyl acetate emulsion.

It is also a preferable mode that a water resistant additive for further improving the image storage characteristics of the heat sensitive recording material by cross-linking the binder component in the protective layer is added to the protective layer. The water resistant additive includes, for example, a water-soluble initial condensates such as N-methylol urea, N-methylol melamine, and urea-formalin, dialdehyde compounds such as glyoxal and glutaraldehyde, inorganic cross-linking agents such as boric acid, borax and colloidal silica, and polyamide epichlorohydrin.

It is a particularly preferable mode that the protective layer comprises a water-soluble polymer and at least one kind of inorganic pigment selected from an aluminum hydroxide, a kaolin and an amorphous silica. By constituting the protective layer in this mode, image storage characteristics can be improved, and simultaneously handling ability and printing suitability can also be conferred. The protective layer can also contain a surfactant, a thermofusible substance and so on.

The volume-average particle diameter of the inorganic pigment contained in the protective layer is preferably 0.5 to 3 μm, more preferably 0.7 to 2.5 μm. Particularly from the viewpoint of improving printing suitability, the inorganic pigment is preferably 0.5 to 1.2 μm aluminum hydroxide, and from the viewpoint of improving ink jet suitability, amorphous silica is preferably used. Measurement of the volume-average particle diameter can be carried out in the same manner as described above for the electron-donating dye precursor, etc.

The total content of inorganic pigments selected from an aluminum hydroxide, a kaolin and an amorphous silica is preferably 10 to 90 weight %, more preferably 30 to 70 weight %, based on the total solid content (weight) of the coating solution for forming the protective layer. Other pigments such as a barium sulfate, a zinc sulfate, a talc, a clay and a colloidal silica may be used in combination in such a range that the effect of the invention (particularly, improvement in image storage characteristics and conferring of handling ability and printing suitability) is not deteriorated.

The water-soluble polymer includes, among the above-mentioned binders, polyvinyl alcohol and modified polyvinyl alcohol (hereinafter referred to collectively as "polyvinyl alcohol"), starch and modified starch such as oxidized starch and urea phosphate starch, and carboxyl group-containing polymers such as a styrene-maleic anhydride copolymer, a styrene-maleic anhydride copolymer alkyl ester, and a styrene-acrylic acid copolymer. Particularly from the viewpoint of printing suitability, polyvinyl alcohol, oxidized starch, and urea phosphate starch are preferable and used particularly preferably mixed such that the weight ratio (x/y) of polyvinyl alcohol (x) to oxidized starch and/or urea phosphate starch (y) is 90/10 to 10/90. Particularly, when all of the polyvinyl alcohol, oxidized starch and urea phosphate starch are simultaneously used, the weight ratio ($y^1/y^2$) of oxidized starch ($y^1$) to urea phosphate starch ($y^2$) is preferably 10/90 to 90/10.

The modified polyvinyl alcohol is preferably acetoacetyl modified polyvinyl alcohol, diacetone modified polyvinyl alcohol, silicon modified polyvinyl alcohol, or amide modified polyvinyl alcohol, and besides, sulfo modified polyvinyl alcohol, carboxy modified polyvinyl alcohol and so on are used. When a cross-linking agent that reacts with such the polyvinyl alcohols is simultaneously used, storage stability, handling ability and printing suitability can be further improved.

The ratio of the water-soluble polymer to the total solid content (weight) of the coating solution for forming the protective layer is preferably 10 to 90 weight %, more preferably 30 to 70 weight %.

Preferable examples of the cross-linking agent for cross-linking the water-soluble polymer include polyvalent amine compounds such as ethylene diamine, polyvalent aldehyde compounds such as glyoxal, glutaraldehyde and dialdehyde, dihydrazide compounds such as adipic acid dihydrazide and phthalic acid dihydrazide, water-soluble methylol compounds (urea, melamine, phenol), multifunctional epoxy compounds, polyvalent metal salts (Al, Ti, Zr, Mg etc.). In particular, the polyvalent aldehyde compounds and dihydrazide compounds are preferable.

The weight ratio (%) of the cross-linking agent to the water-soluble polymer is preferably about 2 to 30, more preferably about 5 to 20. By containing the cross-linking agent, film strength, water resistance and so on can be further improved. Although the mixing ratio of the inorganic pigment selected from an aluminum hydroxide, a kaolin and an amorphous silica to the water-soluble polymer in the protective layer varies depending on the type and particle diameter of the inorganic pigment and the type of the water-soluble polymer, the amount of the water-soluble polymer is preferably 50 to 400 weight %, more preferably 100 to 250 weight %, based on the weight of the inorganic pigment. The total weight of the inorganic pigment and the water-soluble polymer in the protective layer is preferably 50 weight % or more of the total solid weight of the protective layer.

It is another preferable mode that a surfactant is added to the protective layer, that is, a coating solution for forming the protective layer (hereinafter referred to sometimes as "coating solution for protective layer") from the viewpoint of improving ink jet ink suitability. Preferable examples of the surfactant include alkylbenzene sulfonates such as a sodium dodecylbenzenesulfonate, alkyl sulfosuccinates such as a sodium dioctylsulfosuccinate, polyoxyethylene alkyl ether phosphates, sodium hexametaphosphate, perfluoroalkyl carboxylates and so on. Among them, the alkyl sulfosuccinate is more preferable. The content of the surfactant is preferably 0.1 to 5 weight %, more preferably 0.5 to 3 weight %, based on the total solid content (weight) of the coating solution for forming the protective layer.

A coating solution for forming the protective layer can be prepared by dissolving or dispersing the water-soluble polymer, the inorganic pigment selected from an aluminum hydroxide, a kaolin and an amorphous silica and if necessary a cross-linking agent, a surfactant etc. as described above in a desired aqueous solvent. A lubricant, a defoaming agent, a fluorescent brightener, a colored organic pigment and so on can be added to the coating solution in such a range that the effect of the invention (particularly, improvement in image storage characteristics and conferring of handling ability and printing suitability) is not deteriorated. The lubricant includes, for example, metal soap such as a zinc stearate and a calcium stearate and wax such as a paraffin wax, a microcrystalline wax, a carnauba wax and a synthetic polymer wax.

[Support]

The heat sensitive recording material of the invention comprises a heat sensitive recording layer arranged on a support. As the support, a support known in the art can be suitably selected and used. Specific examples of the support include a paper support such as a high-quality paper, a coated paper having a pigment applied onto a paper, a resin-coated paper having a resin applied onto a paper, a resin-laminated paper, a high-quality paper having a primer layer, a synthetic paper, and a transparent support such as a plastic film. A support based on recycled pulp, that is, a support wherein recycled pulp accounts for 50 weight % of the support, can also be used.

From the viewpoint of dot reproduction, the support is preferably a smooth support having a smoothness of 100 seconds or more, more preferably 150 seconds or more stipulated in JIS-P8119. For the same reason as described above, the smoothness stipulated in JIS-P8119 is preferably 300 to 500 seconds.

In the invention, the support is preferably one member selected from a transparent support, a synthetic paper and a resin-coated paper.

When the support is a transparent support, a synthetic paper or a resin-coated paper, smoothness can be made particularly high, and particularly color gradation reproduction is excellent, and when an actual image is observed with the naked eye, image quality excellent in image reproduction from a high-density area to a low-density area can be obtained.

A primer layer may be arranged between the support described above and the heat sensitive recording layer. In this case, the primer layer is arranged preferably on the surface of a support having a stockigt sizing degree of 5 seconds or more and preferably consists primarily of a pigment and a binder. As a pigment for the primer layer, any conventional inorganic and organic pigments can be used. The pigment is particularly preferably an oil-absorbing pigment having an oil absorbency of not less than 40 ml/100 g (cc/100 g) as stipulated in JIS-K5101. Specific examples of the oil-absorbing pigment include calcined kaolin, aluminum oxide, magnesium carbonate, calcinated diatomaceous earth, aluminum silicate, magnesium aluminosilicate, calcium carbonate, barium sulfate, aluminum hydroxide, kaolin, calcimined kaolin, amorphous silica, urea formalin resin powder, and so on. Among them, calcined kaolin having an oil absorbency of 70 ml/100 g to 80 ml/100 g is particularly preferable.

When the primer layer is formed by application onto a support, the amount of the pigment applied is preferably 2 $g/m^2$ or more, more preferably 4 $g/m^2$ or more, more preferably 7 to 12 $g/m^2$.

The binder for the primer layer includes a water-soluble polymer and an aqueous binder. These can be used by itself or in a combination of two or more thereof. The water-soluble polymer includes, for example, starch, polyvinyl alcohol, polyacrylamide, carboxymethyl cellulose, methyl cellulose, casein and so on. The aqueous binder is generally synthetic rubber latex or synthetic resin emulsion, and examples of the aqueous binder include styrene-butadiene rubber latex, acrylonitrile-butadiene rubber latex, methyl acrylate-butadiene rubber latex, vinyl acetate emulsion, and so on.

The amount of the binder used for the primer layer is determined in consideration of the balance among film strength, the heat sensitivity of the heat sensitive recording layer and so on. The amount of the binder used for the primer layer is preferably 3 to 100 weight %, more preferably 5 to 50 weight %, still more preferably 8 to 15 weight %, based on the weight of the pigment for the primer layer. The primer layer may be also added a wax, a discoloration inhibitor, a surfactant and so on.

Coating of the coating solution for forming the primer layer can be carried out by methods known in the art. Specific examples include coating methods of using an air knife coater, a roll coater, a blade coater, a gravure coater, a curtain coater and so on. Among them, coating methods of using a curtain coater or a blade coater are preferable, and a coating method of using a blade coater is more preferable. After coating and drying, the primer layer may be subjected to smoothing treatment such as calendering.

The method of using a blade coater includes not only coating methods of using a blade of bevel- or bent-type but also a rod blade coating method and a bill blade coating method. Coating may be carried out by an off-machine coater or by an on-machine coater arranged on a paper-making machine. For giving excellent smoothness and planarity by conferring fluidity at the time of blade coating, the coating solution for forming the primer layer (coating solution for undercoat layer) may be blended with carboxymethyl cellulose having an etherification degree of 0.6 to 0.8 and a weight-average molecular weight of 20000 to 200000, in amounts of 1 to 5 weight %, preferably 1 to 3 weight %, based on the amount of the pigment described above.

The amount of the primer layer applied is not particularly limited. Depending on the characteristics of the heat sensitive recording material, the amount of the primer layer applied is preferably 2 g/m or more, more preferably 4 $g/m^2$ or more, still more preferably 7 to 12 $g/m^2$.

In the invention, a primed base paper having a primer layer (particularly preferably an oil-absorbing primer layer having heat insulating properties and high planarity) is preferable, and a primed base paper having a primer layer containing an oil-absorbing pigment, formed by using a blade coater, is particularly preferable, from the viewpoint of improving head matching property with a thermal head and of attaining higher sensitivity and image qualities.

The total ion concentration of $Na^+$ ion and $K^+$ ion maintained in the heat sensitive recording material is preferably 1500 ppm or less, more preferably 1000 ppm or less, still more preferably 800 ppm or less, from the viewpoint of preventing corrosion of a thermal head contacting with the heat sensitive recording material. Measurement of the ion concentration of $Na^+$ ion and $K^+$ ion can be carried out by extracting the heat sensitive adhesive recording material with hot water and then measuring the mass of $Na^+$ and $K^+$ ions in the extracting water by ion quantitative analysis by atomic absorption spectroscopy. The total ion concentration is expressed in ppm based on the total weight of the heat sensitive recording material.

In the heat sensitive recording material of the invention, the wetting property of the surface of the heat sensitive recording layer, that is, the contact angle of distilled water that lapsed in 0.1 second after dropping on the surface of the heat sensitive recording layer is preferably 20° or more, more preferably 50° or more. When the contact angle is in the range defined above, bleeding of ink upon printing with an ink jet printer can be prevented (that is, ink jet suitability can be conferred and improved). By containing the electron-accepting compound represented by the formula (I) (preferably 4-hydroxybenzenesulfonanilide), the above-mentioned contact angle can be attained. The above-mentioned contact angle can be also attained by method such as the sensitizer or paraffin wax in the invention can be contained in the heat sensitive recording layer as another material capable of maintaining the contact angle of distilled water on the recording surface.

Measurement of the contact angle can be carried out by dropping distilled water onto the surface (recording surface) of the heat sensitive recording layer of the heat sensitive recording material, and 0.1 second thereafter, measuring its contact angle in a usual manner. For example, the contact angle can be measured with FIBRO system (Dynamic Contact Angle Absorption Tester such as DAT 1100 (manufactured by FIBRO Ltd.)) and so on.

EXAMPLES

Hereinafter, the present invention is described in more detail by reference to examples, but the invention is not limited to these examples. In the Examples, the terms "parts" and "%" refer to "parts by weight" and "% by weight" respectively unless otherwise specified.

Example 1

Preparation of Electron-Donating Dye Precursor Dispersion 20 parts of 3-N,N-dibutylamino-6-methyl-7-anilinofluoran were mixed with 80 parts of an aqueous solution of polyvinyl alcohol (trade name: PVA-105 manufactured by Kuraray Co., Ltd.) at a concentration of 5%. After mixing, the mixture was milled with a sand mill to prepare an electron-donating dye precursor dispersion having a volume-average particle diameter of 0.6 μm. The volume average-particle diameter was measured by a laser diffraction particle size distribution measuring instrument (LA500 manufactured by Horiba, Ltd.).

Preparation of Sensitizer Dispersion 20 parts of 1-benzyloxynaphthalene were mixed with 70 parts of an aqueous solution of polyvinyl alcohol (PVA-105) at a concentration of 5%. After mixing, the mixture was milled with a sand mill to prepare a sensitizer dispersion having a volume-average particle diameter of 0.6 μm. The volume average-particle diameter was measured by a laser diffraction particle size distribution measuring instrument (LA500 manufactured by Horiba, Ltd.).

Preparation of Developer Dispersion 20 parts of 2,4-bis(phenylsulfonyl)phenol were mixed with 70 parts of an aqueous solution of polyvinyl alcohol (PVA-105) at a concentration of 5%. After mixing, the mixture was milled with a sand mill to prepare a developer dispersion (A) having a volume-average particle diameter of 0.6 μm. The volume average-particle diameter was measured by a laser diffraction particle size distribution measuring instrument (LA500 manufactured by Horiba, Ltd.).

Preparation of Coating Solution for Heat Sensitive Recording Layer 3 parts of the electron-donating dye precursor dispersion, 3 parts of the sensitizer dispersion, 3 parts of the developer dispersion (A), 2 parts of 20% hollow particle dispersion SX866 (B) (average particle diameter 0.3 μm, degree of hollowness=67%, manufactured by JSR Co., Ltd.), 0.8 parts of Hydrorin Z-7 (manufactured by Chukyo Yushi Co., Ltd) at a concentration of 31%, 0.8 parts of Hydrorin D337 (manufactured by Chukyo Yushi Co., Ltd) at a concentration of 31%, 1.0 part of 2% sodium (2-ethylhexyl)sulfosuccinate aqueous solution, and 9 parts of water were mixed to give a coating solution (1) for a heat sensitive recording layer.

Preparation of Heat Sensitive Recording Material

As a support, a high-quality paper having a smoothness of 150 seconds according to JIS-P8119 was prepared, and the coating solution (1) for heat sensitive recording layer was applied thereon with a wire bar such that the weight of the heat sensitive recording layer after drying was 6.0 g/m$^2$, followed by drying in an oven at 50° C. Thereafter, the sample was calendered to give a heat sensitive recording material.

Example 2

Preparation of Protective Layer Coating Solution

A protective layer coating solution was obtained by mixing 50 parts of polyvinyl alcohol (PVA-117 manufactured by Kuraray Co., Ltd.) at a concentration of 5%, 0.8 parts of Hydrorin Z-7 (manufactured by Chukyo Yushi Co., Ltd) at a concentration of 31%, 0.8 parts of Hydrorin D337 (manufactured by Chukyo Yushi Co., Ltd) at a concentration of 31%, and 30 parts of water to give a protective layer coating solution.

Preparation of Coating Solution for Heat Sensitive Recording Layer

A coating solution (2) for a heat sensitive recording layer (2) was obtained in the same manner as in Example 1 except that 2 parts of 28% hollow particle dispersion SX8782 (D) (average particle diameter of 1.1 μm, degree of hollowness=82%, manufactured by JSR Co., Ltd.) were used as a hollow particle dispersion in place of SX866 (B).

Preparation of Heat Sensitive Recording Material

The coating solution (2) for a heat sensitive recording layer (2) was applied with a wire bar onto the surface of a synthetic paper support (Karure SNR80 manufactured by Chisso Co., Ltd.) as a support such that the weight of the heat sensitive recording layer after drying was 6.0 g/m$^2$, followed by drying in an oven at 50° C., to prepare a heat sensitive recording layer. Thereafter, the protective layer coating solution was applied onto the heat sensitive recording layer such that the weight of the protective layer after drying was 2.0 g/m$^2$, followed by drying in an oven at 50° C. Thereafter, the sample was calendered to give a heat sensitive recording material.

Example 3

Preparation of Developer Dispersion 20 parts of 4-[4-(1-methylethoxy)phenylsulfonyl]phenol (trade name: D-8, manufactured by Nippon Soda Co., Ltd.) were mixed with 70 parts of an aqueous solution of polyvinyl alcohol (PVA-105) at a concentration of 5%, and then milled with a sand mill to prepare a developer dispersion (B) having an average particle diameter of 0.6 μm.

Preparation of Coating Solution for Heat Sensitive Recording Layer

A coating solution (3) for a heat sensitive recording layer was obtained in the same manner as in Example 1 except that the developer dispersion (B) obtained above was used in place of the developer dispersion (A), and 2 parts of 26% hollow particle dispersion "Hollow Plastic Pigment HPP-055" (average particle diameter of 1.1 μm, degree of hollowness=75%, manufactured by CMKOR Co., Ltd.) were used as a hollow particle dispersion in place of SX866 (B), in preparation of the coating solution (1) for a heat sensitive recording layer of Example 1.

Preparation of Heat Sensitive Recording Material

A heat sensitive recording material was obtained in the same manner as in Example 2 except that the coating solution (3) for heat sensitive recording layer was applied onto the surface of a resin-coated paper having polyethylene (density 0.95) of 20 μm in thickness laminated on both sides of a base paper (basis weight 80 g/m$^2$), such that the weight of the heat sensitive recording layer after drying was 7.0 g/m$^2$.

Example 4

Preparation of Electron-Donating Dye Precursor-Encapsulated Microcapsule Dispersion 14 g of an electron-donating dye precursor 2-anilino-3-methyl-6-N-ethyl-N-sec-butyl aminofluoran, 0.6 g of an ultraviolet absorber Tinubin P (manufactured by Ciba-Geigy Ltd.), 10 g of a capsule wall agent Takenate D-110N (manufactured by Takeda Chemical Industries, Ltd.) and 10 g of Sumidule N3200 (manufactured by Sumitomo Chemical Co., Ltd.) were dissolved in 20 g of ethyl acetate. The solution was mixed with 112 g of 5% polyvinyl alcohol (trade name: PVA217C, manufactured by Kuraray Co., Ltd.) aqueous solution and emulsified at 8000 rpm for 5 minutes with Ace homogenizer (manufactured by Nippon Seiki Co., Ltd.). 142 g of water was further added thereto and the mixture was reacted at 55° C. for 3 hours to prepare an electron donating dye precursor-containing microcapsule dispersion having a capsule size of 0.7 μm.

Preparation of Developer Emulsified Dispersion 7 g of developer (a), 7 g of developer (b), 16 g of developer (c) and 11 g of developer (d) respectively represented by the structural formulae below, 1.7 g of tricresyl phosphate and 0.8 g of diethyl maleate were dissolved in 38 g of ethyl acetate. The solution containing the developers was mixed with an aqueous solution containing 100 g of 8% aqueous polyvinyl alcohol (PVA205C manufactured by Kuraray Co., Ltd.), 150 g of water, and 0.5 g of sodium dodecylbenzenesulfonate, then emulsified at 10,000 rpm at ambient temperature for 5 minutes with Ace Homogenizer (manufactured by Nippon Seiki Co., Ltd.) to give a developer emulsified dispersion having an average particle diameter of 1.0 μm.

Developer (a)

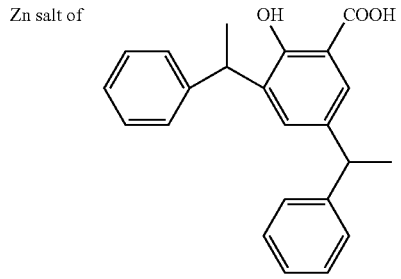

Developer (b)

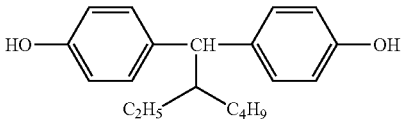

Developer (c)

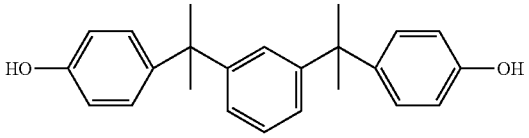

Developer (d)

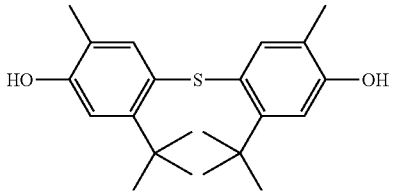

Preparation of Heat Sensitive Recording Material

<<Forming of Heat Sensitive Recording Layer>>

5.0 parts of the electron-donating dye precursor-encapsulated microcapsule dispersion obtained above, 10.0 parts of the developer emulsified dispersion obtained above, 5.0 parts of water, and 3 parts of 20% hollow particle dispersion SX866 (B) (average particle diameter of 0.3 μm, degree of hollowness=67%, manufactured by JSR Co., Ltd.) were mixed while stirring to prepare a coating solution for a heat sensitive recording layer. This coating solution was applied onto one side of a transparent polyethylene terephthalate support of 75 μm in thickness such that the solid content became 10 g/m$^2$, followed by drying, to thereby form a heat sensitive recording layer.

<<Formation of Protective Layer>>

Preparation of Pigment Dispersion 15 parts of Zn stearate-treated aluminum hydroxide (trade name: Heidirite H42S manufactured by Showa Denko K.K.) were added to a mixture consisting of 60 parts of water, 5 parts of 10% polyvinyl alcohol (trade name: PVA205C manufactured by Kuraray Co., Ltd.), and 2 parts of 2% sodium dodecylbenzenesulfonate. Then, the sample was dispersed to impart an average particle diameter of 0.7 μm.

Then, a coating solution for protective layer, having the following composition in terms of solid content, was prepared and applied in an amount of 2.5 g/m$^2$ in terms of solid content onto the heat sensitive recording layer. In this way a heat sensitive recording material was obtained.

| | |
|---|---|
| Polyvinyl alcohol (trade name: PVA124, manufactured by Kuraray Co., Ltd.) | 7 parts |
| The pigment dispersion obtained above | 12 parts |
| Paraffin wax emulsion (trade name: Cerozole 428, manufactured by Chukyo Yushi Co., Ltd.) | 0.9 parts |
| Zinc stearate emulsion (trade name: Highmicron F115, manufactured by Chukyo Yushi Co., Ltd.) | 0.2 parts |
| Polyoxyethylene alkyl ether phosphate (trade name: Neoscore CM57, manufactured by Toho Chemical Industry Co., Ltd.) | 0.05 parts |

Example 5

A heat sensitive recording material was obtained in the same manner as in Example 1 except that a hollow particle dispersion (density 20%) having an average particle diameter of 1.6 μm and a degree of hollowness of 69% was used as a hollow particle dispersion in place of SX866 (B) in preparation of the coating solution (1) for a heat sensitive recording layer (1) of Example 1.

Example 6

A heat sensitive recording material was obtained in the same manner as in Example 1 except that a hollow particle dispersion (density 20%) having an average particle diameter of 8.1 μm and a degree of hollowness of 71% was used as a hollow particle dispersion in place of SX866 (B) in preparation of the coating solution (1) for a heat sensitive recording layer (1) of Example 1.

Comparative Example 1

A heat sensitive recording material was obtained in the same manner as in Example 1 except that a calcium carbonate (Univer 70 manufactured by Shiraishi Kogyo Kaisha Ltd.) containing the same amount of solids as in the hollow particles was used in place of the hollow particle dispersion SX866 (B).

Comparative Example 2

A heat sensitive recording material was obtained in the same manner as in Example 2 except that the hollow particle dispersion SX866 (B) was not added.

Comparative Example 3

A heat sensitive recording material was obtained in the same manner as in Example 3 except that an aluminum hydroxide (Heidirite H42 manufactured by Showa Denko K.K.) dispersion containing the same amount of solids as in the hollow particles was used in place of the hollow particle dispersion SX866 (B).

Evaluation (Color Forming Property)

Each of the resulting heat-sensitive recording materials was used to record an image (step edge) with a thermal head with varying heat energy applied using a thermal printer TRT-8 (Nagano Japan Radio Co., Ltd.). The color optical density of the step edge was determined with a Macbeth densitometer RD-918 (Macbeth Co., Ltd.). The results are shown in Table 1.

(Evaluation of Actual Image)

The resulting heat sensitive recording material was used to print an actual image with a thermal imager FT1500 (manufactured by Fuji Film). The image was observed with the naked eye and evaluated according to the following criteria. The results are shown in Table 1.

<Criteria>

A: High image reproduction from low-density area to high-density area.

B: Low image reproduction in low-density area or high-density area.

C: Low image reproduction in the whole density area.

TABLE 1

| | Background optical density | 5 (mJ/mm$^2$) | 10 (mJ/mm$^2$) | 15 (mJ/mm$^2$) | 20 (mJ/mm$^2$) | 25 (mJ/mm$^2$) | Evaluation of actual image |
|---|---|---|---|---|---|---|---|
| Example 1 | 0.09 | 0.18 | 0.61 | 1.01 | 1.42 | 1.63 | A |
| Example 2 | 0.08 | 0.22 | 0.52 | 0.93 | 1.38 | 1.79 | A |
| Example 3 | 0.10 | 0.25 | 0.55 | 0.96 | 1.43 | 1.82 | A |
| Example 4 | 0.05 | 0.11 | 0.35 | 0.67 | 1.02 | 1.46 | A |
| Example 5 | 0.08 | 0.23 | 0.49 | 0.89 | 1.35 | 1.59 | A |
| Example 6 | 0.08 | 0.14 | 0.44 | 0.96 | 1.21 | 1.28 | B |
| Comparative example 1 | 0.07 | 0.12 | 1.02 | 1.42 | 1.43 | 1.41 | C |
| Comparative example 2 | 0.10 | 0.11 | 0.55 | 1.39 | 1.56 | 1.54 | C |
| Comparative example 3 | 0.09 | 0.10 | 0.35 | 1.06 | 1.60 | 1.63 | C |

As can be seen from Table 1 above, with heat sensitive recording materials of the invention, as compared with those of the Comparative Examples, a color image was formed with high density when low heat energy was applied. Further, the heat sensitive recording materials of the invention show less change of color optical density with respect to heat energy applied and are endowed with soft color gradation to exhibit excellent color gradation reproduction.

As can be seen from the results, the heat sensitive recording materials of the invention exhibit excellent image reproduction in evaluation of the actual image.

According to the invention, there can be provided a heat sensitive recording material excellent in image color gradation reproduction with which it is possible to obtain high sensitivity and image density.

The present invention includes the following embodiment.

<1> A heat sensitive recording material comprising a heat sensitive recording layer provided on a support and having a hollow particle and a heat sensitive coloring component.

<2> The heat sensitive recording material as described in <1>, wherein the average particle diameter of the hollow particle is 5.0 μm or less.

<3> The heat sensitive recording material as described in <1> or <2>, wherein the degree of hollowness of the hollow particle is from 40 to 90%.

<4> The heat sensitive recording material as described in any one of <1> to <3>, wherein the heat sensitive coloring component comprises at least an electron-donating dye precursor and an electron-accepting compound that reacts with the electron-donating dye precursor to form a color.

<5> The heat sensitive recording material as described in any one of <1> to <4>, wherein the support is one selected from the group consisting of a transparent support, a synthetic paper and a resin-coated paper.

<6> The heat sensitive recording material as described in any one of <1> to <5>, which further comprising a protective layer provided on the heat sensitive recording layer.

<7> The heat sensitive recording material as described in <4>, wherein the electron-donating dye precursor is encapsulated in a microcapsule.

<8> The heat sensitive recording material as described in <4>, wherein the electron-accepting compound comprises an electron-accepting compound represented by formula (I) below and an electron-accepting compound selected from salicylic acid derivatives and polyvalent metal salts thereof, formula (I)

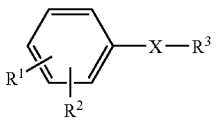

wherein $R^1$ and $R^2$ independently represent a hydrogen atom, an alkyl group, an alkenyl group, a hydroxyl group, a halogen atom or —$SO_2$Ar; $R^3$ represents —Ar, —NH—Ar or —NH—CO—NH—Ar, where Ar represents an aromatic ring and may be substituted with at least one selected from the group consisting of a hydroxyl group, an alkyl group, an alkenyl group, an alkoxy group, a halogen atom and a substituent group containing —$SO_2Ar$; and X represents a divalent linking group represented by any of the following,

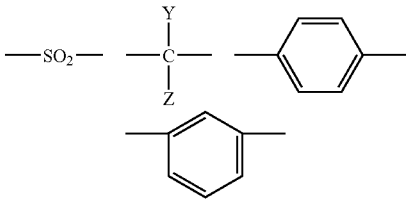

wherein Y and Z independently represent a hydrogen atom or an alkyl group, and Y and Z may be bound to each other to form a ring.

<9> The heat sensitive recording material as described in <8>, wherein the content of the electron-accepting compound represented by formula (I) is 50 weight % or more based on the total weight of the electron-accepting compound.

<10> The heat sensitive recording material as described in <6>, wherein the protective layer comprises a water-soluble polymer and at least one of inorganic pigment selected from the group of aluminum hydroxide, kaolin and amorphous silica.

<11> The heat sensitive recording material as described in <10>, wherein the volume-average particle diameter of the inorganic pigment is from 0.5 to 3 μm.

<12> The heat sensitive recording material as described in <10>, wherein the weight of the water-soluble polymer is 100 to 250 weight % based on the weight of the inorganic pigment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. A heat sensitive recording material comprising a heat sensitive recording layer provided on a support, wherein the heat sensitive recording layer comprises a hollow particle and a heat sensitive coloring component comprising a combination of electron-donating dye precursor fine particles having a volume-average particle diameter of 0.5 μm to 2.0 μm and electron-accepting compound fine particles having a volume-average particle diameter of 0.5 μm to 2.0 μm and reacting with the electron-donating dye precursor upon application of heat energy to thereby develop color, wherein the electron-accepting compound comprises an electron-accepting compound represented by formula (I) below and an electron-accepting compound selected from salicylic acid derivatives and polyvalent metal salts thereof, formula (I)

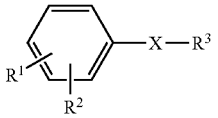

wherein $R^1$ and $R^2$ independently represent a hydrogen atom, an alkyl group, an alkenyl group, a hydroxyl group, a halogen atom or —$SO_2Ar$; $R^3$ represents —Ar, —NH—Ar or —NH—CO—NH—Ar, where Ar represents an aromatic ring and may be substituted with at least one selected from the group consisting of hydroxyl group, an alkyl group, an alkenyl group, an alkoxy group, a halogen atom and a substituent group containing —$SO_2Ar$; and X represents a divalent linking group represented by any of the following,

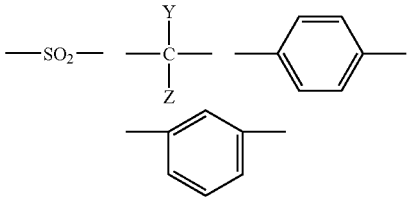

wherein Y and Z independently represent a hydrogen atom or an alkyl group, and Y and Z may be bound to each other to form a ring.

2. The heat sensitive recording material according to claim 1, wherein the average particle diameter of the hollow particle is 5.0 μm or less.

3. The heat sensitive recording material according to claim 1, wherein the degree of hollowness of the hollow particle is from 40 to 90%.

4. The heat sensitive recording material according to claim 1, wherein the support is one selected from the group consisting of a transparent support, a synthetic paper and a resin-coated paper.

5. The heat sensitive recording material according to claim 1, further comprising a protective layer provided on the heat sensitive recording layer.

6. The heat sensitive recording material according to claim 5, wherein the protective layer comprises a water-soluble polymer and at least one inorganic pigment selected from the group consisting of aluminum hydroxide, kaolin and amorphous silica.

7. The heat sensitive recording material according to claim 6, wherein the volume-average particle diameter of the inorganic pigment is from 0.5 to 3 μm.

8. The heat sensitive recording material according to claim 6, wherein the weight of the water-soluble polymer is 100 to 250 weight % based on the weight of the inorganic pigment.

9. The heat sensitive recording material according to claim 1, wherein the electron-donating dye precursor is encapsulated in a microcapsule.

10. The heat sensitive recording material according to claim 1, wherein the content of the electron-accepting compound represented by formula (I) is 50 weight % or more based on the total weight of the electron-accepting compound.

* * * * *